United States Patent [19]

Latham

[11] Patent Number: 4,964,354

[45] Date of Patent: Oct. 23, 1990

[54] STEERING PLATE FOR OUTBOARD MOTOR

[76] Inventor: Robert P. Latham, 280 SW. 32nd Ct., Fort Lauderdale, Fla. 33301

[21] Appl. No.: 516,185

[22] Filed: Apr. 30, 1990

[51] Int. Cl.[5] ..... B63H 25/00

[52] U.S. Cl. ..... 114/144 R; 440/61; 440/900

[58] Field of Search ..... 114/144 R, 144 A; 440/53, 55, 61-63, 900; 74/480 B

[56] References Cited

U.S. PATENT DOCUMENTS 2,714,362 8/1955 Schroeder ..... 114/144 R 3,599,594 8/1971 Taipale ..... 440/53 X 4,826,460 5/1989 Zuckerman ..... 114/144 R X 4,909,765 3/1990 Riske et al. ..... 114/144 R X

*Primary Examiner*—Joseph F. Peters, Jr.

*Assistant Examiner*—Edwin L. Swinehart

*Attorney, Agent, or Firm*—Alvin S. Blum

[57] ABSTRACT

A steering plate attaches to an outboard motor without disturbing the joint between engine mounting and driveshaft housing. The attachment fastens to the motor at the sides and rear in two parallel horizontal planes and a vertical plane for rigidity to resist forces in diverse directions.

2 Claims, 1 Drawing Sheet

FIG. 1
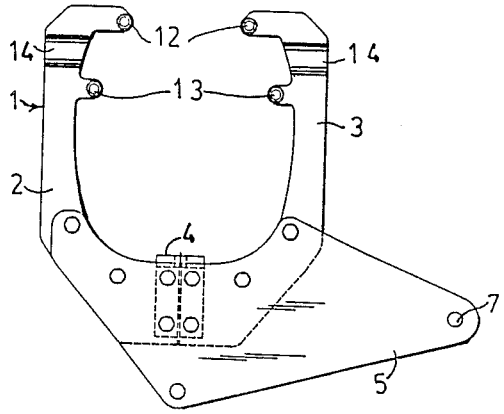
FIG. 8
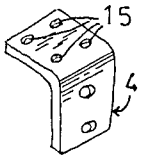
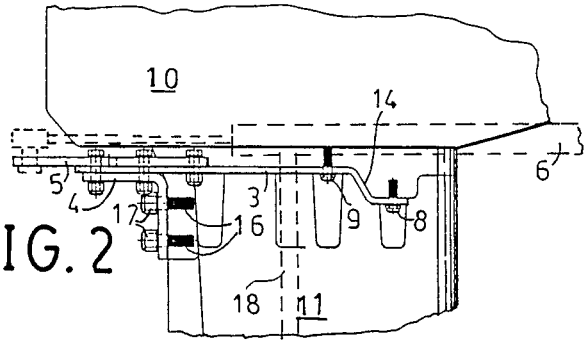
FIG. 2
FIG. 7
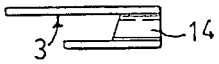
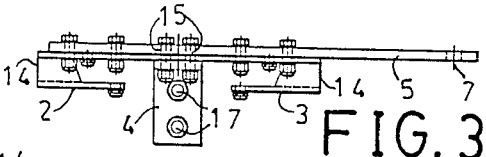
FIG. 3
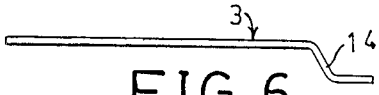
FIG. 6
FIG. 4
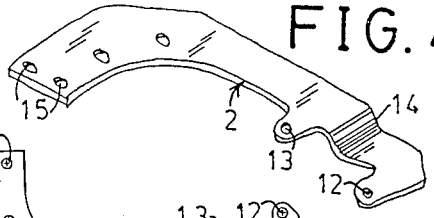
FIG. 5
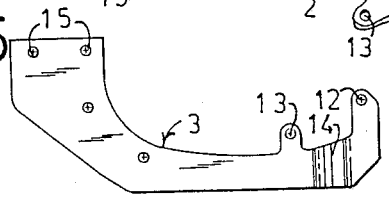

STEERING PLATE FOR OUTBOARD MOTOR

BACKGROUND OF THE INVENTION

This invention relates to attachments to marine propulsion systems and more particularly to plates bolted to outboard motors to which remote control steering mechanisms are connected.

Outboard motors are marine propulsion devices adapted to be mounted on the transom of a boat for pivotal movement relative to the transom about a substantially vertical steering axis. The device includes a vertical drive shaft, a power head rotatably connected to the upper end of the drive shaft and a propeller assembly connected to the lower end of the drive shaft, all arranged as a pivotal unit to pivot about the steering axis aft of the transom mount. The rotating parts are sealed by water tight housings and seals with a rotating horizontal propeller shaft extending through a water seal to permit attachment of the propeller external to the sealed environment.

The steering axis is forward of the drive shaft. The attachment for mounting the device on the transom is connected to the vertical power train by a pivotal tilt axle that is transverse to the steering axis.

Small outboard motors are steered by a rigid handle extending forward of the drive shaft that may include a throttle for control by an operator seated at the motor.

It is more common, especially with larger motors, for the operator to be situated far forward of the one or more motors to be operated by a remote steering device that may include flexible cables or hydraulic cylinders actuated by a steering wheel at one end and attached at the other end by steering attachments to the pivotal unit either forward or aft of the steering axis. This invention is an improvement in the steering attachment to the motor.

With very large, high power, outboard motors the forces generated at the attachment are very great due to the thrust of the propellers and the high speeds in rough waters. It is usual practice to make the attachment at a point far back of the steering axis for greater leverage. This also gives better steering control because a given movement of the cable or cylinder produces a smaller angular change of direction. In the prior art, a horizontal plate was bolted to the motor, usually by sandwiching it between the housings of the upper power head and the drive shaft column using the bolts around the circumference. This is a threat to the water seals if done incorrectly and is labor intensive. The end of the steering cable or hydraulic cylinder is connected to the plate. The horizontal plate is vulnerable to vertical forces since it is only attached at its edge in only one plane.

SUMMARY OF THE INVENTION

It is accordingly an object of the invention to provide a means for connecting the end of a steering element to an outboard motor that is not labor intensive, that does not invade the water seal and distributes the stresses more uniformly about the motor. It is yet another object of the invention to provide an attachment that is more rigid and resistant to forces in diverse directions.

The attachment of the invention bolts onto the motor external to the water seals. It bolts onto the forward portion of the housing using existing studs in two parallel planes and it bolts to the rear portion of the housing using bolts that fasten to holes drilled and tapped into the housing in a plane perpendicular to the other two planes so that the forces are distributed around the entire engine and rigidity is greatly enhanced by the attachment in multiple planes to reduce flexing and vibration.

These and other objects, advantages and features of the invention will become more apparent when the detailed description is studied in conjunction with the following drawings.

BRIEF DESCRIPTION OF THE DRAWINGS

FIG. 1 is a top view of the steering plate of the invention.

FIG. 2 is a side view of the steering plate of the invention in place on an outboard motor.

FIG. 3 is a rear view of the plate of FIG. 2.

FIG. 4 is a perspective view of the port side attachment member.

FIG. 5 is a plan view of the starboard side attachment member.

FIG. 6 is a side view of the member of FIG. 5.

FIG. 7 is a rear view of the member of FIG. 5.

FIG. 8 is a perspective view of the rear member.

DETAILED DESCRIPTION OF THE PREFERRED EMBODIMENT

Referring now first to FIGS. 1 and 2, the invention 1 comprises a port side attachment member 2 and a starboard side attachment member 3, a rear member 4 and a connecting plate 5 to which the hydraulic cylinder 6 or other steering driving element is attached at bolt hole 7. The plate 5 may be inverted to accomodate a cylinder on the port side of the engine. The bolt hole 7 is positioned away from the engine to allow clearance for the engine when turned sharply. This connection 7, being extended so far from the attachment to the motor gives great leverage to any forceful movement of the engine. When the engine is driving forward with hundreds of horsepower, and a wave suddenly lifts the propeller out of the water and back in again, the forces in all directions on the connections are severe. Each side member 2, 3 is bolted anteriorly to two studs 8 and 9 that project downward from the water-tight joint connecting the power head 10 to the housing 11 of the driveshaft 18 through bolt holes 12 and 13 respectively. Each side member has bend 14 so that the attachment to the forward portion of the engine is at two parallel planes for enhanced rigidity. At the rear of the engine, rear member 4 joins the two side members together with bolts through holes 15. Two holes 16 are drilled and tapped in housing 11 to receive bolts 17 to secure rear member 4 to the housing. Connecting plate 5 is bolted to the two side members 2, 3 and the rear member 4 so that a complete, rigid assembly is firmly attached to the engine or outboard motor with four anterior bolts in two parallel planes and two posterior bolts in a plate perpendicular to the other planes to give enhanced vertical stability as well as lateral stability. The anterior studs are engaged without disturbing the water seal at the joint between power head 10 and drive shaft housing 11 and the bolt holes 16 at the rear are sealed water tight as well. The device as shown employs individual members bolted together. Alternatively, two or more of the compartments may be provided permanently connected. The individual members are preferably formed of a strong, corrosion resistant material such as stainless steel.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A steering attachment apparatus for connecting the driven end of a steering actuator to a marine protrusion unit having an engine mounted above a driveshaft with multiple fasteners and a seal forming a water-tight joint between the engine mounting and a driveshaft housing enclosing the driveshaft, the unit adapted to be pivotally mounted on a boat transom for pivotal movement relative to the transom about a steering axis, the steering attachment apparatus comprising:

(a) a port side member and a starboard side member, each having broad, flat upper and lower faces and an inner edge shaped to conform to the contour of said driveshaft housing for fitting against the port and starboard sides and the rear of said driveshaft housing below said joint, said side members meeting each other at the rear of said housing;

(b) each said side member having a first aperture extending between said upper and lower faces adjacent said inner edge and arranged to receive a fastener joining said engine mounting to said housing at a point on the fastener where said fastener extends below said housing to provide secure attachment of said side members in a first plane transverse to said driveshaft without disturbing the integrity of said joint;

(c) a rear member having a first planer portion joined substantially at right angles to a second planar portion, said first planar portion arranged for connection to the lower faces of both said side members, said second planar portion arranged to adjoin a rear surface of said housing and provided with fastener receiving means for receiving at least one fastener means for securely fastening said second portion to the rear surface of said housing; and (d) a steering plate having connecting means for connecting to both said side members and said rear member, said steering plate provided with a receiving element for attachment of said driven end of said steering actuator.

2. The apparatus according to claim 1, in which each said side member has a forward portion that extends downward to a second plane parallel to said first plane and inward to adjoin an anterior portion of said housing, including an aperture thru the second planar portion arranged for receiving another fastener joining said engine mounting and said housing below said joint for further securing said side members without disturbing the integrity of said joint.

* * * * *